US005710963A

United States Patent [19]

Dirx

[11] Patent Number: 5,710,963

[45] Date of Patent: Jan. 20, 1998

[54] TONER POWDER BOTTLE

[75] Inventor: Lieven Dirx, Oud-Turnhout, Belgium

[73] Assignee: Agfa-Gevaert N.V., Mortsel, Belgium

[21] Appl. No.: 552,201

[22] Filed: Nov. 2, 1995

[30] Foreign Application Priority Data

Nov. 4, 1994 [EP] European Pat. Off. ..... 94203219

[51] Int. Cl.[6] ..... G03G 15/08

[52] U.S. Cl. ..... 399/262; 399/258

[58] Field of Search ..... 355/200, 210, 355/245, 260; 118/653; 222/DIG. 1; 399/222, 252, 258, 262

[56] References Cited

U.S. PATENT DOCUMENTS 4,982,771 1/1991 Bertram et al. .

5,040,024 8/1991 Fukuda et al. .

5,089,854 2/1992 Kaieda et al. .

5,248,847 9/1993 Aoyama ..... 222/DIG. 1 X 5,345,297 9/1994 Katakabe et al. .

*Primary Examiner*—Sandra L. Brase

*Attorney, Agent, or Firm*—Brumbaugh, Graves, Donohue & Raymond

[57] ABSTRACT

A toner powder bottle having a base, a top, and intermediate side walls. A powder discharge opening is formed in the base. The bottle includes a bayonet connection for cooperating with a corresponding bayonet connection of a bottle receiving member to which the toner bottle is connected in use. Finger recesses are formed in the side walls adjacent the top, the finger recesses including lateral and axial function edges to facilitate axial and rotational manipulation of the bottle to enable connection of the bottle to the bottle receiving member.

12 Claims, 2 Drawing Sheets

TONER POWDER BOTTLE

FIELD OF THE INVENTION

The present invention relates to a toner powder bottle and to an electrostatographic copying or printing machine provided with a toner powder supply system comprising such a bottle.

BACKGROUND OF THE INVENTION

In an electrostatographic copying or printing machine using a dry toner powder, a certain amount of toner powder is consumed during use and therefore additional toner powder needs to be supplied from time to time. In many machines this is achieved by the use of a toner powder supply system which includes a replaceable toner powder bottle located in an accessible position in the machine. Such a toner powder supply system is described, for example, in U.S. Pat. No. 4,615,364 (Kawata/Konishiroku Photo Industry). A typical toner powder bottle has a base, a top and intermediate side walls, and a powder discharge opening formed in the base. Bayonet connecting means on the bottle co-operate with corresponding bayonet connecting means of a bottle receiving member to which the toner bottle is connected in use. The bottle is provided with a valve having an open position allowing flow of toner powder through the powder discharge opening and a closed position preventing flow of toner powder through the powder discharge opening. Co-operating valve actuating means formed on the bottle and the receiving member actuate the valve into the open position when the bottle is connected to the receiving member and into the closed position when the bottle is disconnected from the receiving member.

When a fresh bottle is to be connected to the receiving member, it is necessary to insert the bottle axially towards the receiving member and then to rotate it by say 90° to cause the bayonet connection to engage. The operator achieves this by holding the bottle by its top. Similarly, when it is necessary to remove a used bottle, it has to be rotated in the opposite sense to disengage the bayonet connection and then withdrawn axially. Again the operator achieves this by holding the bottle at its top.

The need for the operator to handle the bottle from its top necessitates the provision of space inside the machine which could otherwise be used to accommodate a toner powder bottle of larger volume.

SUMMARY OF THE INVENTION

It is an object of the present invention to provide a toner powder bottle of substantially maximum possible volume in which axial and rotational manipulation of the bottle is facilitated to enable connection of the bottle to the bottle receiving member.

According to a first aspect of the invention, there is provided a toner powder bottle having a base, a top and intermediate side walls, a powder discharge opening formed in the base and bayonet connecting means for co-operating with corresponding bayonet connecting means of a bottle receiving member to which the toner bottle is connected in use, characterised by finger recesses formed in the side walls adjacent the top, the finger recesses including lateral and axial function edges to facilitate axial and rotational manipulation of the bottle to enable connection of the bottle to the bottle receiving member.

According to a second aspect of the invention, an electrostatographic copying or printing machine is provided with a toner powder supply system comprising a toner powder bottle receiving member and a removable toner powder bottle, as defined above, the bottle including a valve having an open position allowing flow of toner powder through the powder discharge opening and a closed position preventing flow of toner powder through the powder discharge opening, and co-operating valve actuating means formed on the bottle and the receiving member to actuate the valve into the open position when the bottle is connected to the receiving member and into the closed position when the bottle is disconnected from the receiving member.

By providing finger recesses in the side walls of the bottle, the operator is able to insert the bottle in the machine, and remove it when it needs to be replaced, by access from the side, rather than from the top. Manipulation of the bottle is less hindered by the walls of the machine while the bottle can be designed to have the maximum possible volume. In other words it is not necessary to sacrifice volume in order to allow space for the operator to manipulate the bottle.

The toner powder bottle receiving member may be part of a toner hopper which feeds toner powder to the developing station of the machine. The receiving member may be so positioned in the machine that when the bottle is connected thereto, the bottle is in the vertical position or in a position offset from the vertical provided that the toner powder freely falls towards the discharge opening of the bottle.

The bottle sides may include an upper frusto-conical portion, a lower frusto-conical portion and an. intermediate cylindrical portion, the finger recesses being provided in the upper frusto-conical portion.

Preferably from three to six finger recesses are provided in the side walls. The bayonet connecting means and the valve actuating means are preferably operable by rotation of the bottle through an angle of between 60° and 120°, such as about 90°.

Each the finger recess may have a generally trapezoidal configuration, side edges thereof forming the lateral function edges and top and bottom edges thereof forming the axial function edges.

Preferably the side walls of the bottle are substantially free from protrusions, thereby enabling the bottle to be designed with the maximum possible volume, given the space available within the machine.

Preferably the inside surface of the side walls of the bottle is so shaped, in the vicinity of the finger recesses, to reduce the formation of dead spaces. This is to ensure, that when the bottle is placed in position in the machine, all the toner powder in the bottle will fall towards the powder discharge opening.

PREFERRED EMBODIMENTS OF THE INVENTION

The invention will now be further described, purely by way of example, by reference to the accompanying drawings in which.

Figure 1:
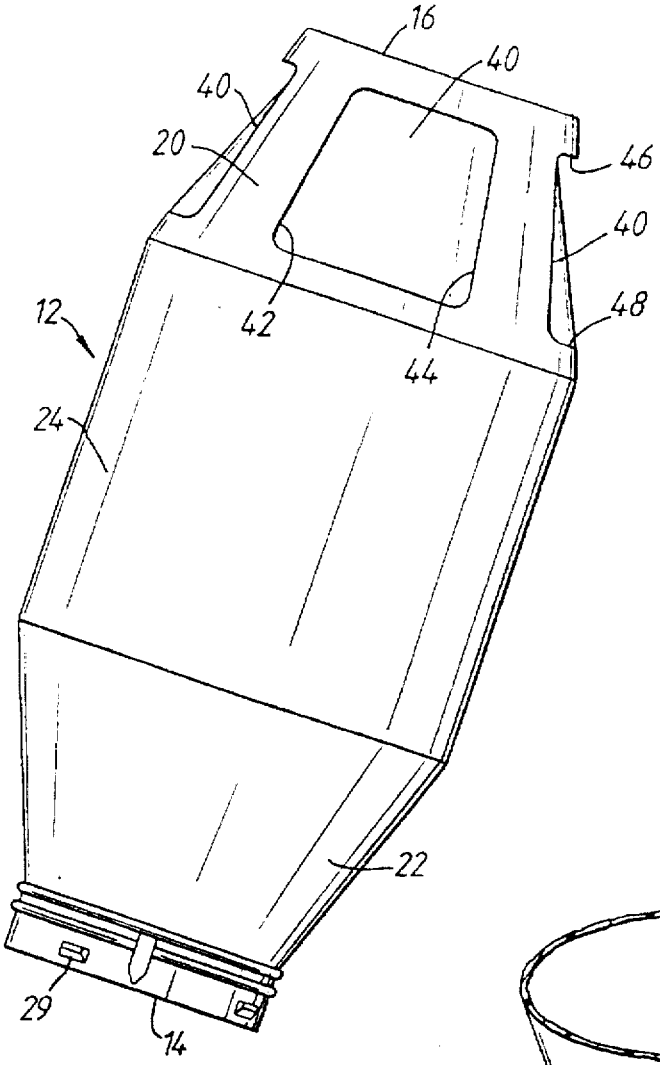
FIG. 1 shows part of a toner powder bottle according to the invention.

Referring to the FIG. 1, there is shown part of a toner powder bottle 12 formed of blow moulded plastics material.

the bottle has an open base 14, a closed top 16 and intermediate side walls 18. The side walls 18 are substantially free from protrusions to enable the bottle to be of the maximum possible volume to fit within the space available inside an electrostatographic copier or printer. The bottle 12 has a generally circular cross-section, the side walls 18 including an upper frusto-conical portion 20, a lower frusto-conical portion 22 and an intermediate cylindrical portion 24. A powder discharge opening 25 is defined by the open base 14. The base 14 includes fixing lugs 29 to which a powder discharge valve (not shown in FIGS. 1 and 3) is fitted.

Figure 2:
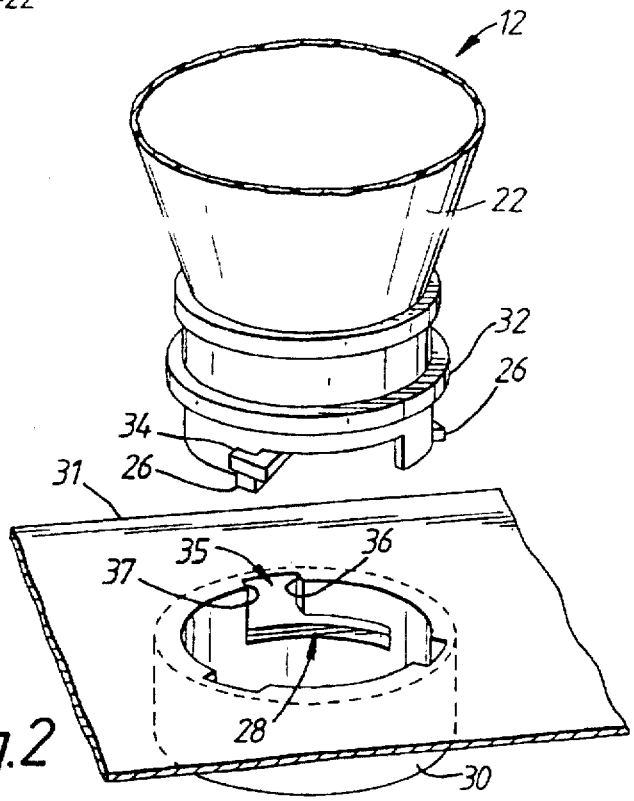
FIG. 2 is an exploded view of part of the toner bottle shown in FIG. 1 together with a bottle receiving member of an electrostatographic printing machine.

Referring to FIG. 2, there is shown the lower frusto-conical portion 22 of the bottle having a powder discharge valve 32 fixed to the base of the bottle. The valve 32 has an open position allowing flow of toner powder through the powder discharge opening 25 and a closed position preventing flow of toner powder through the powder discharge opening 25. The valve is injection moulded and is of the type described and shown in Research Disclosure 28104 (September 1987) and includes a protruding actuator arm 34, which is rotatable relative to the body of the valve 32 to open the valve. Also formed on the valve body are equally angularly spaced three bayonet claws 26.

The bottle 12, together with it attached valve 32, are connected in use to a bottle receiving member in the form of a hopper piece 30, carried on a support plate 31 of the toner hopper 38 (indicated in FIG. 4) of a copying or printing machine. The hopper piece 30 is in the form of an open cylinder having three bayonet grooves 28 formed in the walls thereof, opening via notches 35 to the upper face of the hopper piece 30. In mounting the bottle 12 in the hopper piece 30, the bayonet claws 26 co-operate with the bayonet grooves 28 formed on the hopper piece 30. The notches 35 each have a first side face 36 which acts upon the actuator arm 34 of the valve 32, such that as the bottle is rotated clockwise to engage the bayonet claws 26 in the bayonet grooves 28, the actuator arm 34 is rotated relative to the valve body causing the valve 32 to open. The bayonet connecting means 26 and the valve actuating means 34, 36 are operable by rotation of the bottle 12 through an angle of 90°. The notches 35 also each have a second side face 37 which acts upon the actuator arm 34 of the valve 32 when the bottle is rotated anti-clockwise to release the bayonet claws 26 from the bayonet grooves 28, for example when the bottle is to be replaced, the actuator arm 34 is rotated in the opposite direction relative to the valve body causing the valve 32 to close. The bottle can therefore be removed from the machine without fear of spillage of any remaining toner powder which may remain therein.

Four finger recesses 40 are formed in the upper frusto-conical portion 20 of the side walls 18 adjacent the top 16. Each finger recess 40 has a generally trapezoidal configuration, side edges 42, 44 thereof forming lateral function edges and top and bottom edges 46, 48 thereof forming axial function edges. The function edges facilitate axial and rotational manipulation of the bottle 12 to enable connection of the bottle 12 to the hopper piece 30.

Figure 3:
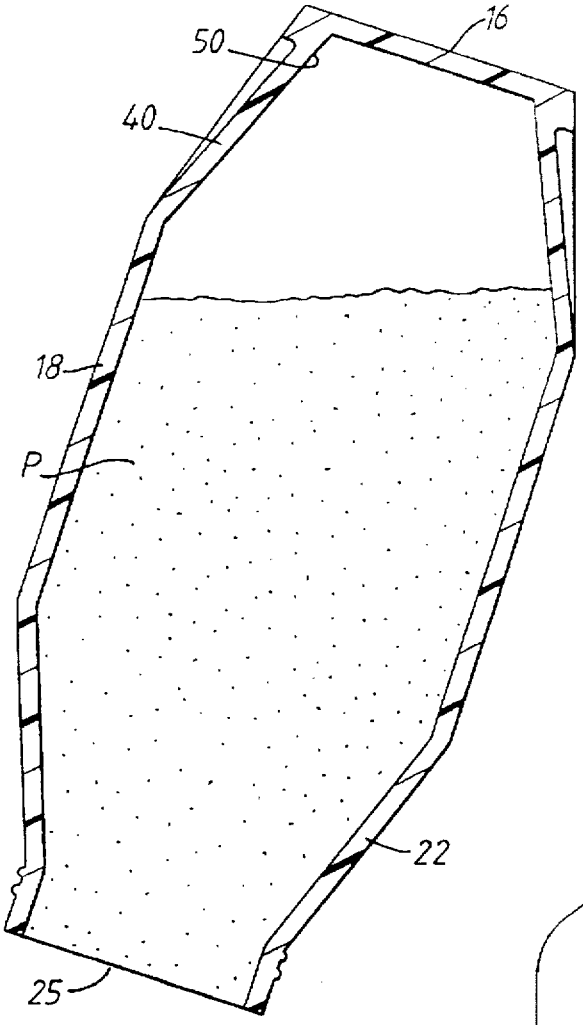
FIG. 3 is an axial cross-sectional view of the part of the toner bottle shown in FIG. 1.

Referring to FIG. 3, it can be seen that the bottle contains toner powder P. The inside surface 50 of the side walls 18 is so shaped, in the vicinity of the finger recesses 40, to avoid the formation of dead spaces. That is, the inside surface does not necessarily closely follow the profile of the outer surface in the vicinity of the finger recesses 40, thereby to prevent the formations of regions within the bottle where toner powder P may become lodged and prevented from falling towards the powder discharge opening 25. This feature helps to ensure substantially complete emptying of the toner powder bottle in use.

Figure 4:
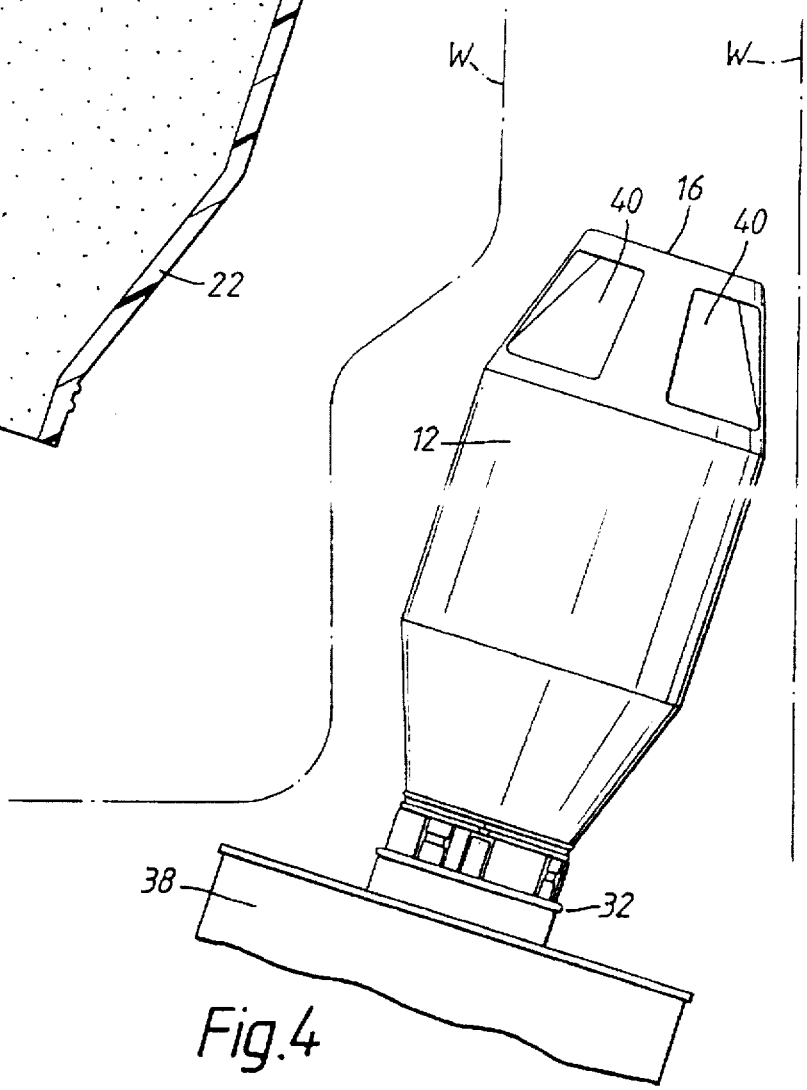
FIG. 4 shows the toner bottle in position in a printing or copying machine.

FIG. 4 shows the bottle 12 in position in a printing or copying machine. The dashed lines W indicate the position of adjacent walls and other components of the machine. These walls and components restrict access to the top 16 of the bottle. The provision of the finger recesses 40, in the side walls of the bottle, enable the operator to insert the bottle 12 in the machine and connect it to the hopper 38, by access from the side, rather than from the top. Manipulation of the bottle is thereby less hindered by the walls of the machine while the bottle is designed to have the maximum possible volume.

The bottle shown in the accompanying Figures holds approximately 1.25 kg toner powder and is used as a replacement for a conventional bottle which held 0.45 kg powder.

I claim:

1. A toner powder bottle comprising a base, a top, side walls including an upper frusto-conical portion, a lower frusto-conical portion and an intermediate cylindrical portion, a powder discharge opening formed in said base, bayonet connecting means for co-operating with corresponding bayonet connecting means of a bottle receiving member to which said toner bottle is connected in use; and finger recesses formed in said side walls adjacent said top in said upper frusto-conical portion, said finger recesses including lateral and axial function edges to facilitate axial and rotational manipulation of said bottle to enable connection of said bottle to said bottle receiving member.

2. A toner bottle according to claim 1, wherein at least three of said finger recesses are provided in said side walls.

3. A toner bottle according to claim 1, wherein no more than six of said finger recesses are provided in said side walls.

4. A toner bottle according to claim 1, wherein said side walls are substantially free from protrusions.

5. A toner bottle according to claim 1, wherein the inside surface of said side walls is so shaped, in the vicinity of said finger recesses, to avoid the formation of dead spaces.

6. A toner bottle according to claim 1, wherein each of said finger recesses has a generally trapezoidal configuration and includes side edges, said side edges constituting said lateral function edges, and top and bottom edges, said top and bottom edges constituting said axial function edges.

7. A toner powder bottle comprising a base, a top, intermediate side walls, a powder discharge opening formed in said base, bayonet connecting means for co-operating with corresponding bayonet connecting means of a bottle receiving member to which said toner bottle is connected in use, and finger recesses formed in said side walls adjacent said top, said finger recesses including lateral and axial function edges to facilitate axial and rotational manipulation of said bottle to enable connection of said bottle to said bottle receiving member, each of said finger recesses having a generally trapezoidal configuration including side edges, said side edges constituting said lateral function edges, and top and bottom edges, said top and bottom edges constituting said axial function edges.

8. A toner bottle according to claim 7, wherein at least three of said finger recesses are provided in said side walls.

9. A toner bottle according to claim 7, wherein no more than six of said finger recesses are provided in said side walls.

10. A toner bottle according to claim 7, wherein said side walls are substantially free from protrusions.

11. A toner bottle according to claim 7, wherein the inside surface of said side walls is so shaped, in the vicinity of said finger recesses, to avoid the formation of dead spaces.

12. In an electrostatographic copying or printing machine, a toner powder supply system comprising a toner powder bottle receiving member and a removable toner powder bottle, said bottle comprising a base, a top, intermediate side walls, a powder discharge opening formed in said base, co-operating bayonet connecting means formed on said bottle and said receiving member to connect said bottle to said receiving member in use, a valve having an open position allowing flow of toner powder through said powder discharge opening and a closed position preventing flow of toner powder through said powder discharge opening, co-operating valve actuating means formed on said bottle and said receiving member to actuate said valve into said open position when said bottle is connected to said receiving member and into said closed position when said bottle is disconnected from said receiving member, said bayonet connecting means and said valve actuating means being operable by rotation of said bottle through an angle between 60° and 120°, and finger recesses formed in said side walls adjacent said top, said finger recesses including lateral and axial function edges to facilitate axial and rotational manipulation of said bottle to enable connection of said bottle to said bottle receiving member.

* * * * *